United States Patent [19]

Slusarenko

[11] 4,053,025

[45] Oct. 11, 1977

[54] SCAFFOLD INCLUDING REVERSIBLE AND ADJUSTABLE DRIVING AND STEERING UNIT

[76] Inventor: John A. Slusarenko, 6724 Coleman Creek Road, Medford, Oreg. 97501

[21] Appl. No.: 705,052

[22] Filed: July 14, 1976

[51] Int. Cl.[2] ..... B60K 7/00

[52] U.S. Cl. ..... 180/2 R; 180/15; 180/65 R; 182/16

[58] Field of Search ..... 180/2, 15, 12, 13, 17, 180/65 R; 182/13, 16

[56] References Cited

U.S. PATENT DOCUMENTS

| | | | |
|---|---|---|---|
| 3,023,825 | 3/1962 | Rabjohn | 180/15 |
| 3,232,375 | 2/1966 | Warthen | 182/16 X |
| 3,256,954 | 6/1966 | Warthen | 182/16 X |
| 3,731,758 | 5/1973 | Hibma | 180/11 |
| 3,865,203 | 2/1975 | Hibma | 180/2 |

FOREIGN PATENT DOCUMENTS

| | | | |
|---|---|---|---|
| 309,087 | 3/1969 | Sweden | 180/15 |

*Primary Examiner*—Joseph F. Peters, Jr.
*Assistant Examiner*—Terrance L. Siemens
*Attorney, Agent, or Firm*—Clarence M. Crews

[57] ABSTRACT

A simple and versatile knock-down scaffold structure is provided, complete in itself, supported on four normally inert corner wheels, and capable, through adjustment and/or substitution of parts, to be varied in length, width and/or height, is modified by the optional addition of a power driving and steering unit comprising a fifth wheel and a reversible, variable speed driving motor therefor, through which the scaffold may be driven forward or backward, being desirably steered and controlled as to speed and direction by a workman on the scaffold. The power driving and steering unit may be varied in height to accommodate whatever variations of height are available in the conventional scaffold structure. It may also be varied in ground pressure to increase the driving traction as desired.

8 Claims, 11 Drawing Figures

SCAFFOLD INCLUDING REVERSIBLE AND ADJUSTABLE DRIVING AND STEERING UNIT

This invention relates to erectable scaffolds and more particularly to the conversion of inert or manually movable scaffolds to scaffolds which may be power-driven forward or backward at controlled speed, and steered by a workman preferably from a driving and steering station on the scaffold.

It is common practice to provide a scaffold consisting of identical end frame members, each comprising two tubular corner posts with an idler wheel at each corner, a series of cross-connecting bars on which platform members may be selectively fitted at different convenient levels, and a central vertical bar. A user of scaffolding of this kind will frequently have on hand pairs of end frame members of different widths to meet different needs.

The corner posts are desirably hollow tubular members to which transverse extension end members having additional cross-members for supporting the platform members may be applied in interfitting relation for increasing the available height of the platform supporting end members and the consequent available height of the platform members.

In the conventional structure each of the four corner posts is supported through a ground engaging roller which is free to rotate and is free to pivot about a vertical axis, and each roller unit desirably includes roller braking means operable between a set position in which the roller is free to rotate or a set position in which the roller is individually locked against rotation. The opposite ends of the conventional scaffold are generally indistinguishable from one another.

In accordance with the present invention a supplemental driving and steering means is provided preferably centrally at one end of the scaffold which is thereby made the leading end, and a supplemental wheel directing means is provided at the opposite or trailing end which causes the rear wheels always to point straight ahead.

In the drawing forming part of this specification, a preferred embodiment of the invention is illustratively disclosed.

Figure 1:
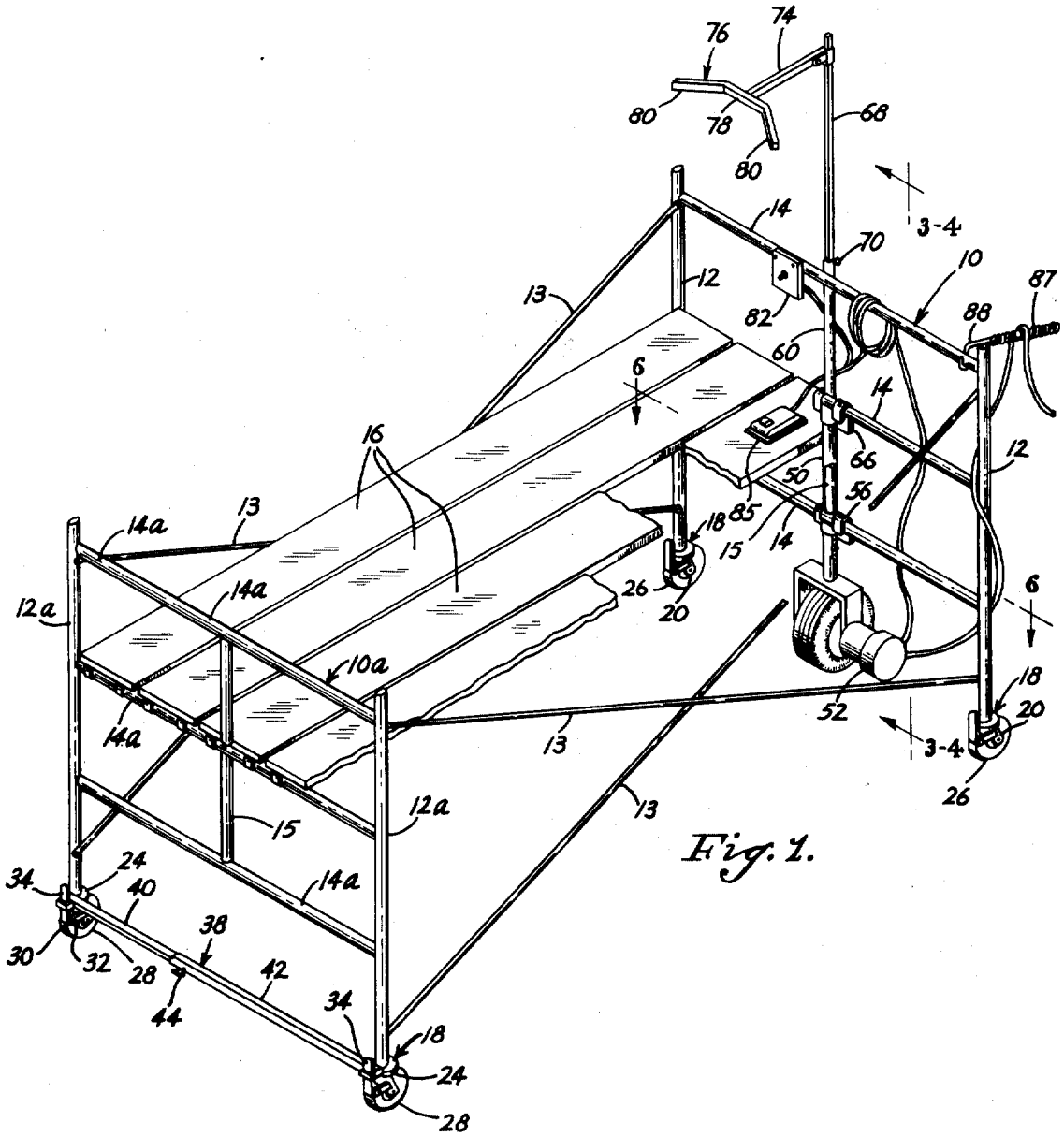
FIG. 1 is a perspective view of an illustrative power-driven scaffold adapted to be steered and driven forward or backward, preferably by a workman situated on the scaffold.
Figure 2:
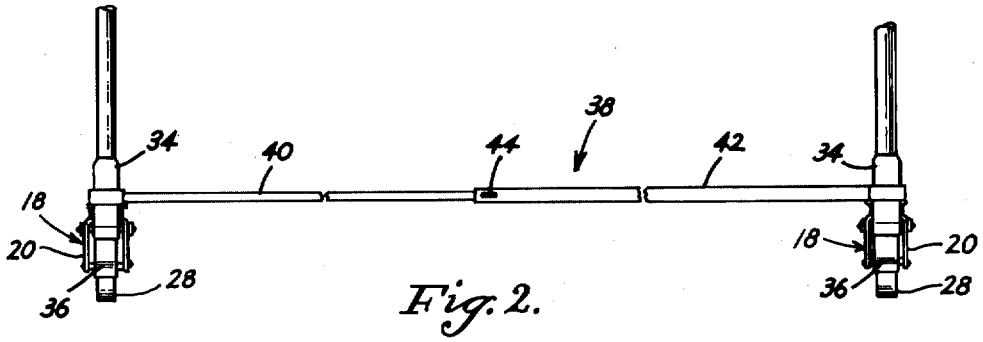
FIG. 2 is a fragmentary detail view of the lower rear end of the structure of FIG. 1, showing means for compelling the rear rollers always to point directly forward, and means operable simultaneously to lock both rear wheels in a braked condition.
Figure 3:
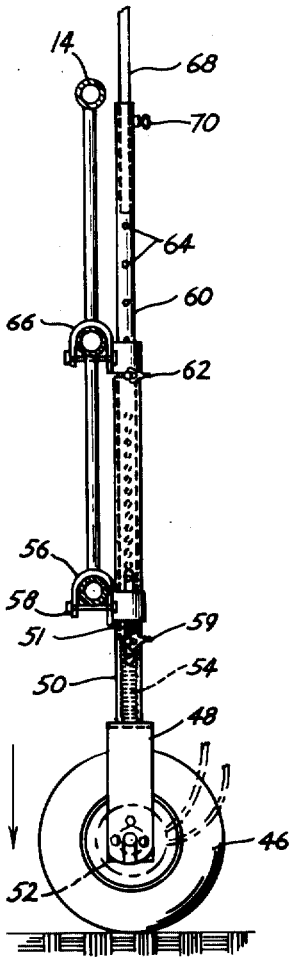
FIGS. 3 and 4 are detail views showing the scaffold driving and steering unit set for applying different pressures to the scaffold driving wheel.
Figure 4:
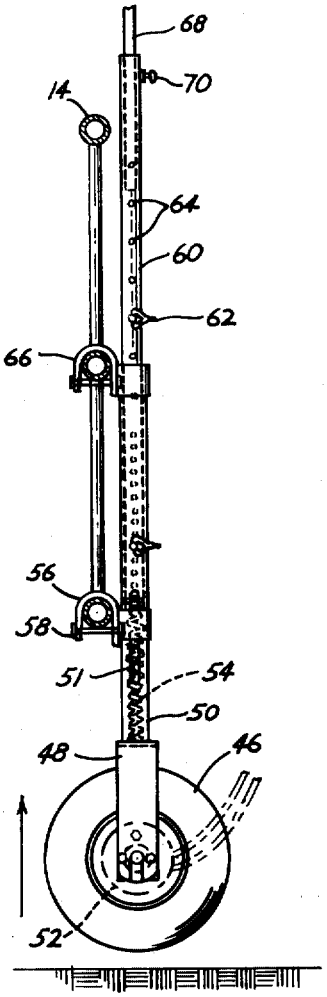
Figure 5:
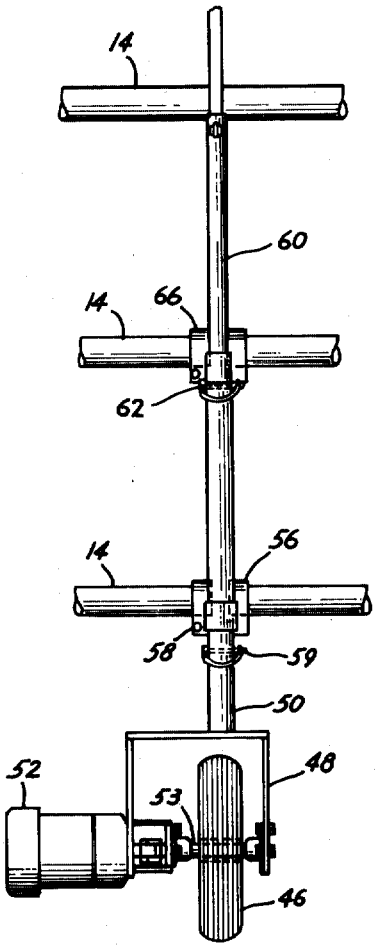
FIG. 5 is a fragmentary view in front elevation showing the relationship of the drive wheel and the steering mechanism to the scaffold with the drive wheel pointed straight ahead.
Figure 6:
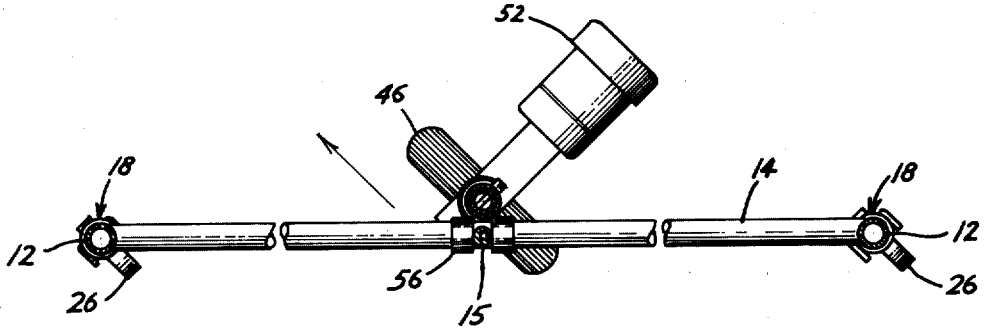
FIG. 6 is a fragmentary view showing the driving motor and the driving and steering wheel turned at a sharp angle and the front corner wheels turned, in consequence, at the same sharp angle indicated by an arrow.
Figure 7:
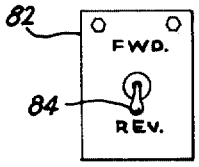
FIG. 7 is a view in elevation of a reversing switch through which the direction of rotation of the motor is prearranged.
Figure 8:
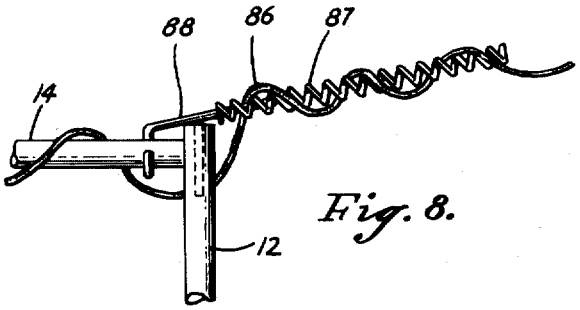
FIG. 8 is a detail view showing the relationship of a conductor to a supporting spring for keeping the electric line in good order.
Figure 9:
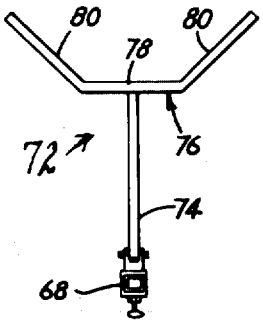
FIG. 9 is a perspective view of the handle bars through which the scaffold is steered.
Figure 10:
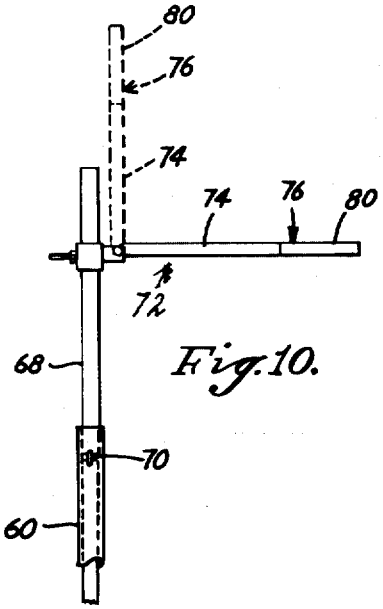
FIG. 10 shows the handle bars in full line in normal steering position, and in broken lines in an upturned, out of the way but still operative position.

The scaffold will first be described as it would be without the applicant's improvements added, and his improvements and their association with the conventional structure will then be described and explained.

The illustrative scaffold comprises end members 10 and **10*a*, which are desirably, but not necessarily, identical. As shown, upright corner posts 12 and 12*a* are permanently joined by cross-bars 14 and 14*a*. At each side of the scaffold the posts 12,12 and 12*a*,12*a* are connected to one another detachable, crossed rods 13. The corner posts 12 and 12*a* are tubular members which may be supplemented by interfitted post extending members, not shown, when and if desired, for increasing the height of the scaffold. Such extension members would also include reinforcing cross-bars like 14 and 14*a*** to increase the effective height of the scaffold as and if required.

Platform members 16 are hooked at their opposite ends onto selected cross-members 14 and **14*a* of corresponding height. Each corner post 12 and 12*a* is fitted at its lower end with a roller bearing caster 18. The post and caster have opposed horizontal bearing discs and the caster has a stem which fits through the disc portion of the post and is normally freely rotatable therein. Each illustrative end member 10 and 10*a* also includes a vertical post 15 which is desirably centrally located. The forward one is broken away in FIG. 1 to reveal other structure. Each caster has spaced inclined arms 20 in which the roller is rotatably carried. Because the arms 20 are inclined, each roller axis is offset relative to the vertical axis of the caster stem, so that, unless restrained, the caster turns, causing the roller axes to follow the caster axes regardless of the directon of travel of the scaffold. This relationship is maintained and availed of in the case of the front rollers 26, but is desirably nullified in accordance with the present invention as regards the rear rollers 28**. This will be later explained.

Figure 11:
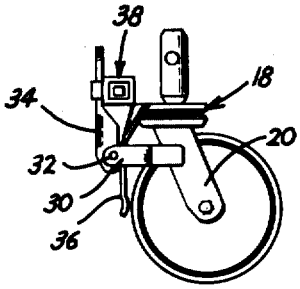
FIG. 11 shows in vertical side elevation and on a larger scale a corner wheel and caster together with optionally effective wheel locking means carried by the caster.

Each rear corner roller 28 has associated with it a braking means which may be maintained in an effective or an ineffective condition as required. Such braking means is carried by the caster. As best seen in FIG. 11 the roller carrying arms 20 of each caster have unitary with them two rearwardly extending horizontal arms 30. Each pair of arms 30 carries at its outer end a cross-pin 32 upon which a cam member 34 is pivotally supported by and between the rearwardly extending arms. A braking plate 36 has side notches that receive and slidably fit marginal portions of the rearwardly extending arms 30 and is slidably supported on the arms between the cam member and the wheel. An upstanding handle portion of the cam member 34 which has the form of a flat plate is operable to turn the cam member, causing the cam at the lower end of said member to press the slidable braking plate 36 firmly against the associated wheel for locking the wheel against turning. The cam member when so operated is frictionally retained against release.

As herein illustrated the front corner rollers are not provided individually with braking means, and this is the preferred arrangement when a front driving and steering unit is available. If it is not available, a front unit exactly like the rear unit is equally serviceable.

In accordance with the present invention, steering and electrical driving means are provided at one end of the scaffold, which end is thereby characterized as the front end. As shown, the driving and steering means is provided at the middle of the front end. This is a preferred, but not an essential, relationship.

Under this condition it is desirable to restrain the casters 24 which carry the rear corner rollers 28 against all pivotal movement while leaving the rollers free to rotate. The rear rollers are thus forced always to face straight ahead. For this purpose a bar 38 is provided consisting of telescoping sections 40 and 42. A set screw 44 threaded through one side of the outer section 42 can be set to lock the sections at a desired combined length. Each section has near its free end a slot which is adapted to receive and fit the upstanding tongue of cam member 34 of the associated wheel assembly. This positively compels the rear rollers 28 to face directly forward at all times but it does not interfere with rotation of the rollers.

When it becomes desirable, because of sloping terrain, for example, to lock the rear rollers against rotation, the rollers may be so locked through operation of the bar 38, simultaneously to turn to locking position both of the cam members 34 with which it is interfitted. Similarly, the rollers may be simultaneously unlocked by operation of the cam members 34 through the bar 38.

The primary feature of the present invention has to do with the provision of novel and highly effective steering and power-driving means at the center of the front end of the scaffold. Both from the standpoint of steering and of power drive, it is highly desirable, though not essential, that the steering means and the driving means be centered at the front of the scaffold. The center post 15 at the front of the scaffold which is shown only in part is exactly like the vertical center post 15 which is shown in its entirety at the rear, and is utilized for centering purposes.

A rubber-tired wheel 46 of comparatively large diameter is located at the front of the scaffold, being revolubly supported in a forked carrier 48, which carrier is equipped with a hollow vertical stem 50. A variable speed, reversible motor 52 is carried by the frame, the motor shaft 53 being disposed to extend across the frame and to serve as a drive mounting for the wheel 46.

Provision is made for forcing the wheel downward with chosen force for providing suitable traction.

The stem 50 wich takes the form of a hollow sleeve at its lower end and has diametrically opposed slots 51 in its sides, has a compression coil spring 54 lodged in the stem 50 and bears downward at its lower end against the carrier frame 48. The hollow stem or sleeve 50 is desirably centered on a front cross-bar 14 and is affixed thereto by a two-pronged hanger 56 that is unitary with the sleeve, and has prongs at each side of the vertical bar 15 that extend downward around the horizontal bar 14. A cross-pin 58 extends across the mouth of the hanger to fix the hanger in place.

After the cross-pin 58 is installed the sleeve 60 is depressed to impose a desirable stress on spring 54. Cross-pin 62 is then inserted in holes 64 to provide the required wheel traction. The compression spring mechanism also allows for continued motive power even though variations in floor height may exist. If there is debris on a floor the unit, because of spring loading, will climb over it without affecting the scaffolding corner rollers' contact with the floor. The roller 46 will also spring down into limited depessions, 3 to 4 inches deep, without losing tractive force.

A second sleeve 60 fits inside the sleeve 50 and extends far enough down to bear against the cross-pin 59 at the upper end of the spring 54. The sleeve 60 is forced down against the cross-pin 59 to compress the spring 54 to a desired extent. A cross-pin 62 is then inserted through chosen aligned holes 64 in the second sleeve 60, just below an upper hanger bracket 66 for maintaining the traction providing spring 54 compressed to the desired degree.

A steering column 68, desirably rectangular in cross-section, telescopes with the upper end of the sleeve 60 for height adjustment and is fixed in place by a set screw 70. The sfeering column 68 carries at its upper end handle bars 72 which comprise a stem 74 pivotally connected for up and down movement to the steering column and a handle portion 76 which comprises a central crossing portion 78 and rearwardly inclined end portions 80.

The handle bars can either be used in a horizontal position or in a vertical position. They were so shaped that in horizontal position they may be manipulated by the workman's body if the workman has something important to do with his hands. In vertical position, on the other hand, they make the entire platform surface available to the workman.

As has been noted, the drive motor is of a reversible, variable speed type. A control device 82 at the end of a control cord located conveniently within reach of the steersman has a switch 84 which can be set to either foward or reverse position without setting the scaffold into motion. A solid state device 85 through which the speed of scaffold travel can be regulated is also provided within convenient reach of the steersman.

The regulating means is desirably carried at the end of a cord 86 which may be draped on the steering mechanism. For keeping the electric cord in good order a coil spring 87 is affixed to the frame member 14 by means of a bracket 88.

Although the corner wheels and the individual braking means therefor are not new, the fact that it is new to compel the trailing corner wheels to point straight ahead at all times, and to lock and unlock the trailing corner wheels in unison, is a significant feature of the invention.

The motor preferably used in connection with the illustrative scaffold is desirably one designed for operation at ten thousand revolutions per minute but it is geared down to a maximum of sixty revolutions per minute. As a consequence the motor can serve as an effective brake when the scaffold is used outdoors on sloping ground.

Because the corner posts are hollow they may be extended, radically to increase the height of the scaffold as desired. In this connection extensions of stem 68 are desirably made available so that the steersman may stand on the platform 16 at whatever level the platform may be installed.

I have described what I believe to be the best embodiment of my invention. What I desire to cover by letters patent, however, is set forth in the appended claims.

I claim:

1. A scaffold including, in combinaton, a steering and driving unit which scaffold has a front end frame member that includes roller supported corner posts, cross-bars that connect the corner posts, and a vertical intermediate steering and driving bar, and said unit having, in combination, a. a drive wheel, b. a wheel and motor supporting frame on which the drive wheel is revolably mounted, c. carrying means for the motor supporting frame adapted for attachment to an end frame member of the scaffold, d. a reversible, variable speed wheel driving motor carried by said motor supporting frame, e. driving connections between the motor and the drive wheel, and f. steering means at the forward end of the scaffold conveniently accessible to an occupant of the scaffold for controlling the direction in which the drive wheel points, the drive wheel frame being carried by a drive wheel stem having supporting plural prong hangers which hang on cross-bars of the scaffold end frame member and embrace a vertial bar thereof.

2. A scaffold steering and driving unit as set forth in claim 1 in which the wheel supporting frame is carried at the lower end of the vertically extending drive wheel stem and provision is made of spring means for thrusting the frame and the wheel carried by it downward with regulated, predetermined pressure.

3. A scaffold steering and driving unit as set forth in claim 2 in which the means for thrusting the wheel carrying frame downward comprises a lower hollow stem affixed to the wheel and motor carrying frame, an inner stem telescopically received in the lower stem, and a compression coil spring within the lower stem, constructed and arranged to apply an upward thrust to the inner stem, and a resilient downward thrust to the wheel and motor carrying outer stem.

4. A scaffold steering and driving unit as set forth in claim 1 in which the hangers include sleeves in which upper and lower portions of the stem are revolvably mounted for turning in unison with one another.

5. A scaffold steering and driving unit as set forth in claim 4 in which a steering column is provided as an upward extension of the stem together with means for adjusting the exposed length of the steering column, and a handle bar device is vertically adjustable on the steering column.

6. A scaffold steering and driving unit as set forth in claim 5 in which the handle bar includes a supporting member adjustably mounted on the steering column, a stem pivotally mounted for up and down movement on said supporting member, and a pair of divergent handle bars unitary with said stem.

7. A knock-down scaffold comprising, in combination, a. front and rear rigid end frame members, each of which includes a pair of corner posts, each post having a freely pivotal roller caster at its lower end and an offset wheel mounted on the caster, a plurality of cross-connecting bars available as platform supports at different levels, and an intermediate vertical bar, b. means rigidly connecting said front and rear rigid frame members to one another, c. a steerable driving roller mounted at one end of the scaffold together with power means for driving said roller, and d. a locking bar adapted for application to the rear casters for locking the rear casters in straight-ahead positions, the construction and arrangement being such that the front corner rollers will automatically assume the direction of the driving roller, but the rear corner rollers will be always compelled to point straight ahead.

8. A knock-down scaffold as set forth in claim 7 in which each corner post at at least one end of the scaffold includes arms that extend horizontally from the corner roller caster shafts, cams pivotally mounted on the free ends of said arms and having upstanding handle portions, a brake member slidably mounted on each pair of horizontal arms, and a bar constructed and arranged to be fitted onto the upstanding portions of said cams, and serving both normally to preclude turning of the rollers significantly away from a straight-away attitude, and when depressed to lock both of the rollers simultaneously against rotation.

* * * * *